US008770066B2

(12) United States Patent
Chang

(10) Patent No.: US 8,770,066 B2
(45) **Date of Patent: *Jul. 8, 2014**

(54) WATER AND DUST RESISTANT RATCHET WRENCH

(76) Inventor: Chih-Min Chang, Changhua County (TW)

( * ) Notice: Subject to any disclaimer, the term of this patent is extended or adjusted under 35 U.S.C. 154(b) by 266 days.

This patent is subject to a terminal disclaimer.

(21) Appl. No.: 13/308,894

(22) Filed: Dec. 1, 2011

(65) Prior Publication Data

US 2013/0118317 A1 May 16, 2013

(51) Int. Cl.
*B25B 13/46* (2006.01)

(52) U.S. Cl.
CPC ..... *B25B 13/463* (2013.01)
USPC ..... 81/63; 81/63.2

(58) Field of Classification Search
USPC ..... 81/63, 63.2
See application file for complete search history.

(56) References Cited

U.S. PATENT DOCUMENTS

| | | | | | |
|---|---|---|---|---|---|
| 4,561,329 | A * | 12/1985 | Lack | ..... | 81/62 |
| 4,934,220 | A * | 6/1990 | Slusar et al. | ..... | 81/63.2 |
| 6,125,722 | A * | 10/2000 | Hopper et al. | ..... | 81/63 |
| 6,453,779 | B2 * | 9/2002 | Hu | ..... | 81/63 |
| 6,575,060 | B1 | 6/2003 | Tseng et al. | | |
| 6,711,973 | B2 * | 3/2004 | Arnold et al. | ..... | 81/63.2 |
| 6,971,287 | B2 * | 12/2005 | Lee et al. | ..... | 81/63.2 |
| 7,311,019 | B2 * | 12/2007 | Arnold et al. | ..... | 81/63.2 |
| 7,353,735 | B2 * | 4/2008 | Patel et al. | ..... | 81/63 |
| 7,861,620 | B2 * | 1/2011 | Arnold et al. | ..... | 81/63.2 |
| 8,056,447 | B2 * | 11/2011 | Arnold et al. | ..... | 81/63.2 |
| 8,474,351 | B2 * | 7/2013 | Arnold et al. | ..... | 81/63.2 |

* cited by examiner

*Primary Examiner* — David B Thomas
(74) *Attorney, Agent, or Firm* — Browdy and Neimark, PLLC

(57) ABSTRACT

A ratchet wrench includes a handle, a ratchet wheel rotatably mounted in a head of the handle, a direction controller pivotally mounted in the head of the handle, and a pawl connected with the direction controller and engaged with the ratchet wheel. An O-ring is provided between the wall of a pivot hole of the handle head and the direction controller, such that the ratchet wrench is water and duct resistant so as to prevent the internal parts of the ratchet wrench from damage due to corrosion.

14 Claims, 4 Drawing Sheets

WATER AND DUST RESISTANT RATCHET WRENCH

BACKGROUND OF THE INVENTION

1. Field of the Invention

The present invention relates generally to ratchet wrenches, and more particularly, to a ratchet wrench which is water and dust resistant.

2. Description of the Related Art

Conventional reversible ratchet wrenches usually use a direction controller to drive the pawl to move between a left position and a right position. When the pawl is stayed in the left position, the rotatable ratchet wheel that is engaged with the pawl may freely rotate in a counterclockwise direction. On the contrary, the ratchet wheel may freely rotate in a clockwise direction when the pawl is stayed in the right position. The detailed structure of such reversible ratchet wrench can be learned from U.S. Pat. No. 6,575,060.

Because the above-mentioned conventional ratchet wrench does not provide any water and dust resistant mechanism at the installation position of the direction controller, the conventional ratchet wrench can not prevent water or dust from entering into an inside thereof. As a result, the controller and other internal parts of the conventional ratchet wrench tend to be corroded or jammed after the ratchet wrench is used for a long time.

SUMMARY OF THE INVENTION

The present invention has been accomplished in view of the above-noted circumstances. It is therefore one objective of the present invention to provide a ratchet wrench, which is water and dust resistant.

To achieve the above-mentioned objective, the water and dust resistant ratchet wrench provided by the present invention comprises a handle, a ratchet wheel, a direction controller, a pawl and at least one O-ring. The handle has a head provided with a mounting hole and a pivot hole communicated with the mounting hole. The ratchet wheel is rotatably mounted in the mounting hole of the head of the handle. The direction controller is pivotally mounted in the pivot hole of the head of the handle. The pawl is connected with the direction controller and engaged with the ratchet wheel for being driven by the direction controller to change an engagement orientation between the pawl and the ratchet wheel so as to control a rotation direction of the ratchet wheel. The O-ring is sleeved onto the direction controller and abutted with a wall surface of the pivot hole of the handle for providing a water and dust resistant effect.

In a preferred embodiment of the present invention, the ratchet wrench further comprises a positioning member installed in a receiving hole communicating with the pivot hole of the head of the handle. The positioning member includes a spring installed in the receiving hole, and a steel ball stopped at the spring and selectively engaged with one of two positioning notches provided at the direction controller so as to hold the direction controller in a certain position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
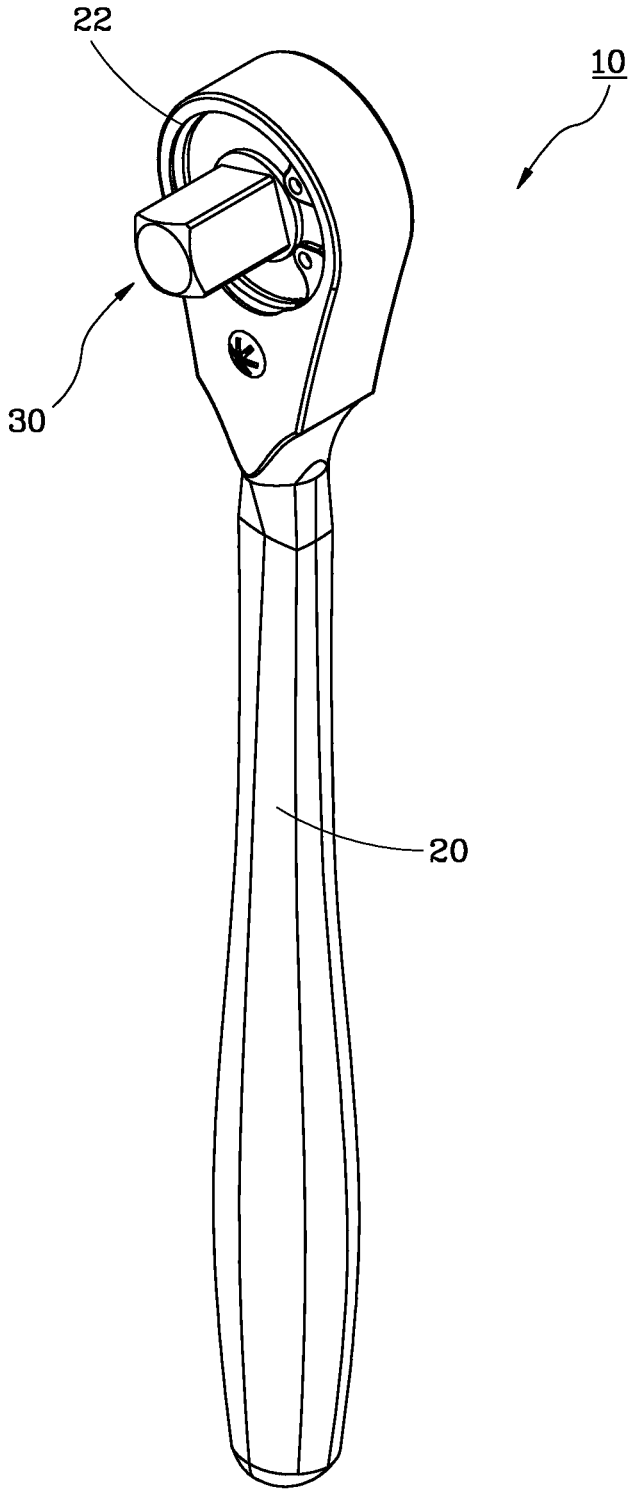
FIG. 1 is a perspective view of a ratchet wrench according to a preferred embodiment of the present invention.
Figure 2:
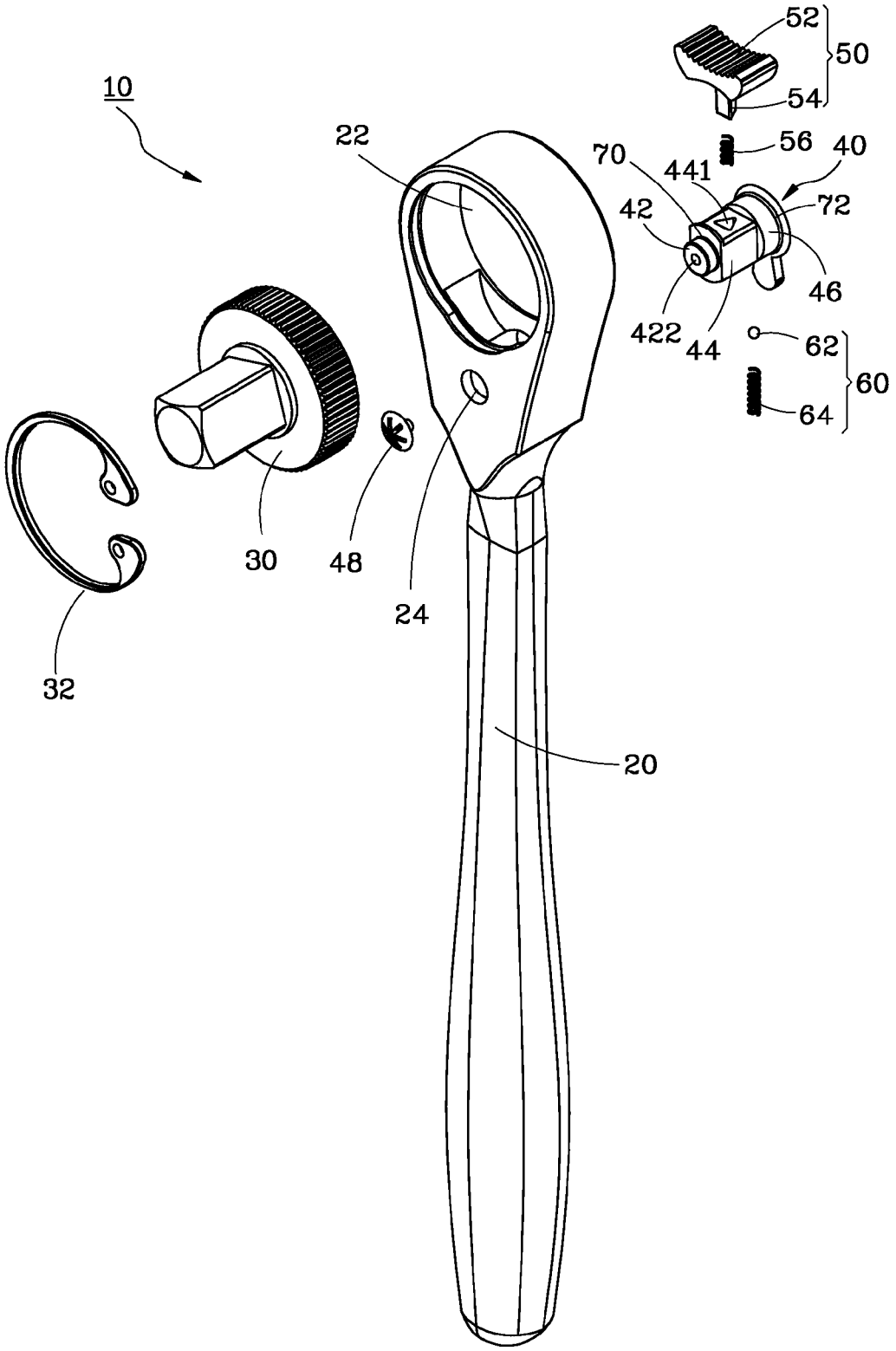
FIG. 2 is an exploded view of the ratchet wrench of the preferred embodiment of the present invention.

As shown in FIGS. 1 and 2, a ratchet wrench, which is provided by a preferred embodiment of the present invention and denoted by the reference numeral 10, comprises a handle 20, a ratchet wheel 30, a direction controller 40, a pawl 50, a positioning member 60 and two O-rings 70 and 72.

Figure 3:
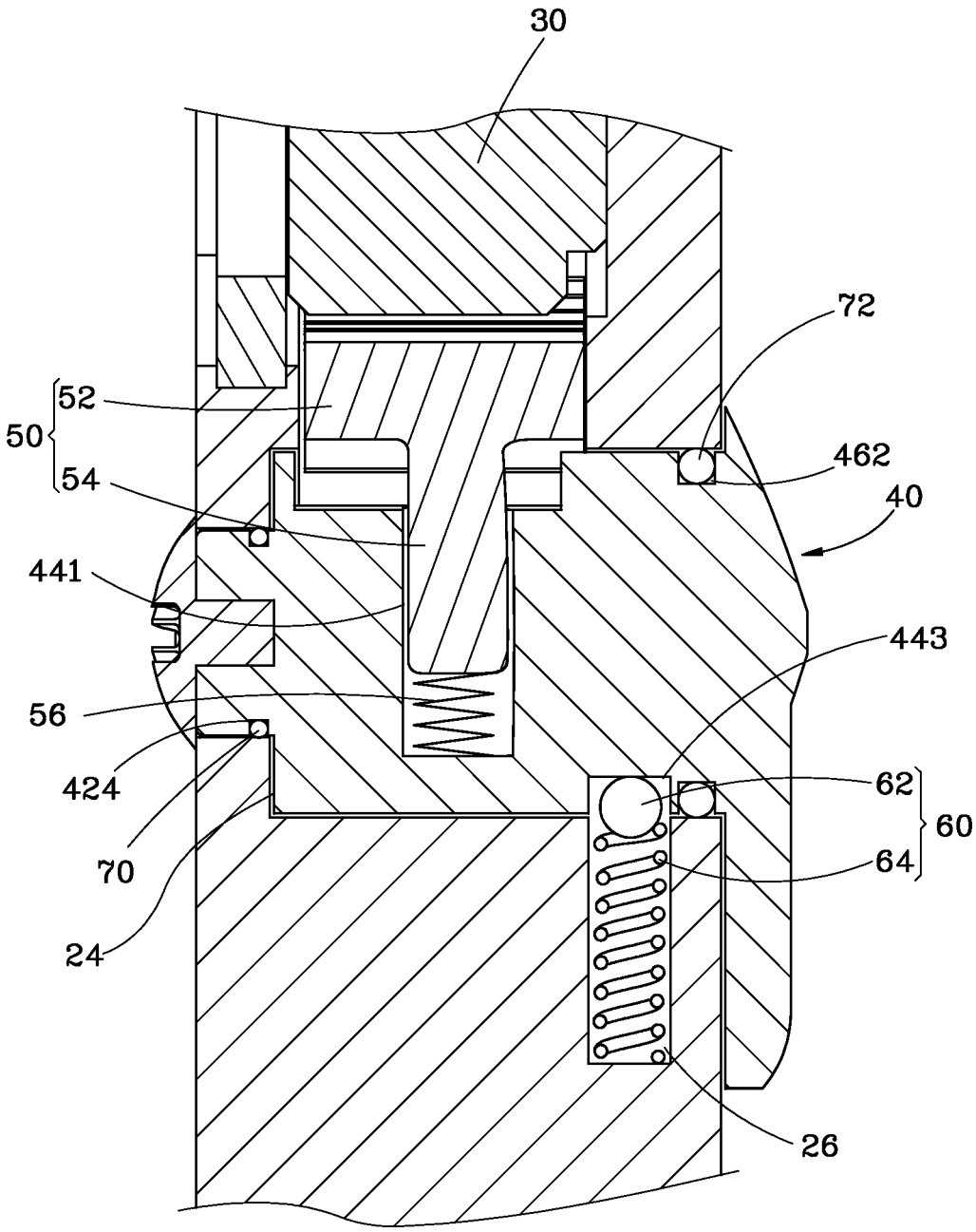
FIG. 3 is a partially cross-sectional view of the ratchet wrench of the preferred embodiment of the present invention, showing the installation positions of the O-rings.

The handle 20 has a head provided with a ratchet wheel mounting hole 22, a pivot hole 24 communicated with the mounting hole 22, and a receiving hole 26 inwardly and radially recessed from a wall of the pivot hole 24 such that the receiving hole 26 is communicated with the pivot hole 24 as shown in FIG. 3.

The ratchet wheel 30 is rotatably mounted in the mounting hole 22 of the head of the handle 20 by a C-shaped retainer 32.

Figure 4:
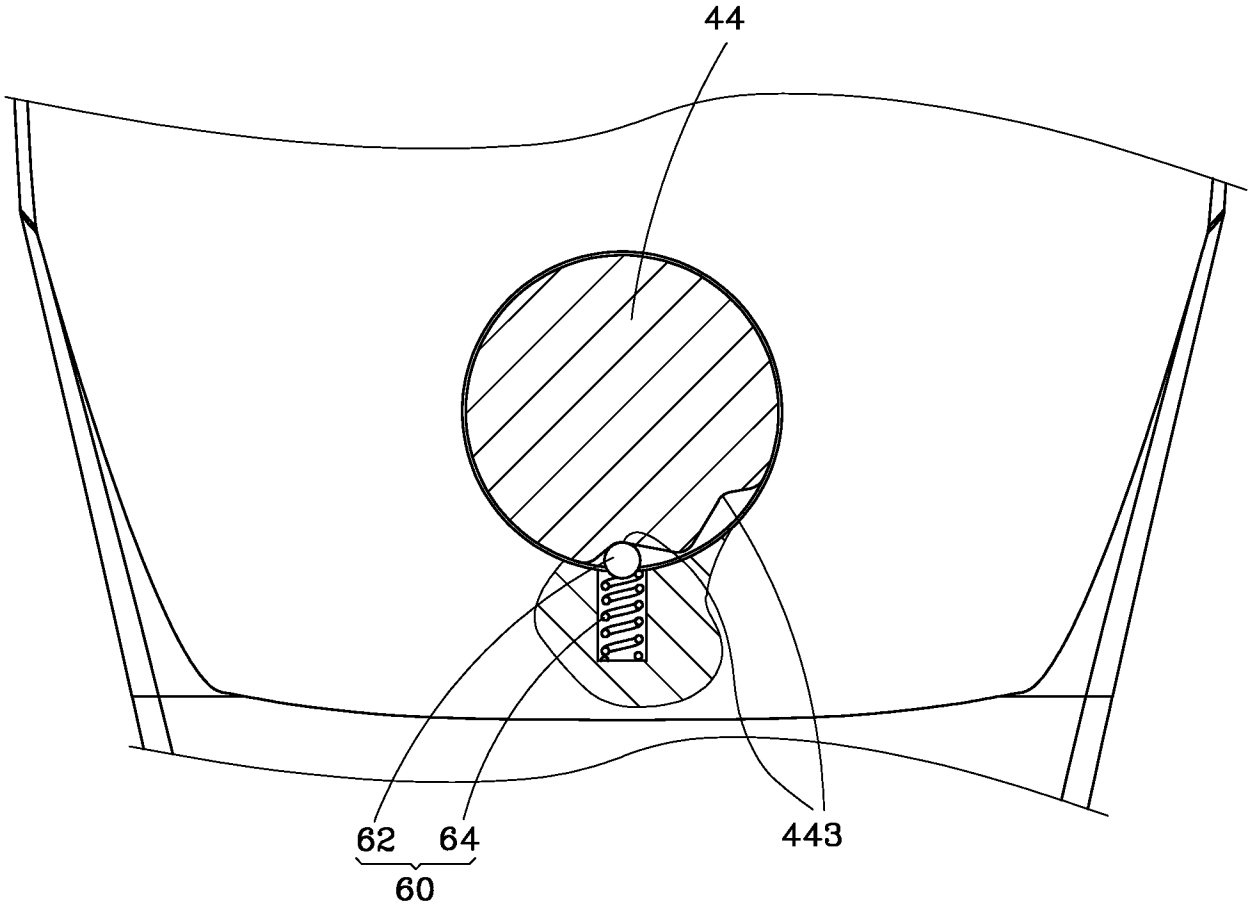
FIG. 4 is another partially cross-sectional view of the ratchet wrench, showing the relationship of the positioning notches of the direction controller and the positioning member.

The direction controller 40 has a pivot portion 42, a connecting portion 44, and a tab 46 to be operated by a user. The pivot portion 42 has a threaded hole 422 for being engaged with a screw 48. By means of the engagement of the screw 48 with the threaded hole 422, the pivot portion 42 of the direction controller 40 can be pivotally installed in the pivot hole 24 of the handle 20 and the direction controller 40 will not escape from the handle 20. On an outer periphery of the pivot portion 42 of the direction controller 40 a first annular groove 424 is provided. The connecting portion 44 is integrally formed with the pivot portion 42 and provided at its top with an insertion hole 441 having a triangular cross section, and at its bottom with two positioning notches 443, which are arranged side by side as shown in FIG. 4. The tab 46 is integrally formed with the connecting portion 44 and partially exposed outside the pivot hole 24 of the handle 20, such that the tab 46 can be operated by a user to swiveledly drive the pivot portion 42 of the direction controller 40 to rotate in the pivot hole 24. On an outer periphery of the tab 46 of the direction controller 40 a second annular groove 462 is provided.

The pawl 50 includes a tooth portion 52 engaged with the ratchet wheel 30, and a shaft 54 extending from a bottom of the tooth portion 52. The shaft 54 has a triangular cross section to be loosely fitted with the insertion hole 441 of the direction controller 40. Specifically speaking, the shaft 54 is slidably inserted into the insertion hole 441 with its bottom end stopping against a first spring 56 that is installed inside the insertion hole 441. By means of the rebound force of the first spring 56, the pawl 50 can be properly engaged with the ratchet wheel 30. In addition, the pawl 50 can be driven by the direction controller 40 to change the engagement orientation between the pawl 50 and the ratchet wheel 30 so as to control the rotation direction of the ratchet wheel 30.

The positioning member 60 is installed in the receiving hole 26 of the handle 20, including a steel ball 62 and a second spring 64 installed inside the receiving hole 26. The steel ball 62 is stopped at the second spring 64 and can be selectively engaged with one of the positioning notches 443 to hold the direction controller 40 in position.

The first O-ring 70 is installed in the first annular groove 424 of the pivot portion 42 of the direction controller 40 and abutted against the wall surface of the pivot hole 24 of the handle 20. Further, the second O-ring 72 is installed in the second annular groove 462 of the tab 46 of the direction controller 40 and abutted against the wall surface of the pivot hole 24 of the handle 20.

From the above-disclosed description it can be seen that two O-rings 70 and 72 are provided between the direction controller 40 and the wall of the pivot hole 24 of the handle 20; therefore, water or dust will be prohibited from entering into an inside of the handle 20 through the pivot hole 24 during the use of the ratchet wrench 10. By this way, it can prevent the internal parts of the ratchet wrench 10, such as the direction controller 40, pawl 50, spring 56 and positioning member 60, from corrosion or being jammed.

In the above-mentioned preferred embodiment of the present invention, two O-rings 70 and 72 are installed at two end portions of the direction controller 40 for achieving the water and dust resistant purpose; however, it will be appreciated that one or more O-rings can be used in between the direction controller 40 and the wall of the pivot hole 24 of the handle 20 for providing the water and dust resistant effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water and dust resistant ratchet wrench, comprising:

a handle having a head provided with a mounting hole and a pivot hole communicated with the mounting hole;

a ratchet wheel rotatably mounted in the mounting hole of the head of the handle;

a direction controller pivotally mounted in the pivot hole of the head of the handle;

a pawl connected with the direction controller and engaged with the ratchet wheel for being driven by the direction controller to change an engagement orientation between the pawl and the ratchet wheel so as to control a rotation direction of the ratchet wheel; and at least one O-ring sleeved onto the direction controller and abutted with a wall surface of the pivot hole of the handle;

wherein the direction controller comprises a pivot portion pivotally mounted in the pivot hole of the head of the handle, a connecting portion integrally formed with the pivot portion and connected with the pawl, and a tab integrally formed with the connecting portion and partially exposed outside the pivot hole of the head for being operated to drive the pivot portion of the direction controller to rotate in the pivot hole; wherein the tab is provided at an outer periphery thereof with an annular groove in which the O-ring is installed; and wherein the connecting portion of the direction controller includes an insertion hole, and the pawl includes a tooth portion engaged with the ratchet wheel, and a shaft inserted into the insertion hole of the connecting portion of the direction controller.

2. The water and dust resistant ratchet wrench of claim 1, wherein a spring is installed in the insertion hole of the direction controller and stopped at the shaft of the pawl.

3. The water and dust resistant ratchet wrench of claim 1, wherein the insertion hole of the direction controller and the shaft of the pawl both have a triangular cross section.

4. The water and dust resistant ratchet wrench of claim 1, wherein the head of the handle comprises a receiving hole in communication with the pivot hole, and the connecting portion of the direction controller is provided with two positioning notches; a spring is installed in the receiving hole of the head of the handle and a steel ball is stopped at the spring and selectively engaged with one of the positioning notches.

5. A water and dust resistant ratchet wrench, comprising:

a handle having a head provided with a mounting hole and a pivot hole communicated with the mounting hole;

a ratchet wheel rotatably mounted in the mounting hole of the head of the handle;

a direction controller pivotally mounted in the pivot hole of the head of the handle;

a pawl connected with the direction controller and engaged with the ratchet wheel for being driven by the direction controller to change an engagement orientation between the pawl and the ratchet wheel so as to control a rotation direction of the ratchet wheel; and at least one O-ring sleeved onto the direction controller and abutted with a wall surface of the pivot hole of the handle;

wherein the direction controller comprises a pivot portion pivotally mounted in the pivot hole of the head of the handle, a connecting portion integrally formed with the pivot portion and connected with the pawl, and a tab integrally formed with the connecting portion and partially exposed outside the pivot hole of the head for being operated to drive the pivot portion of the direction controller to rotate in the pivot hole; wherein the pivot portion is provided at an outer periphery thereof with an annular groove in which the O-ring is installed.

6. The water and dust resistant ratchet wrench of claim 5, wherein the connecting portion of the direction controller includes an insertion hole, and the pawl includes a tooth portion engaged with the ratchet wheel, and a shaft inserted into the insertion hole of the connecting portion of the direction controller.

7. The water and dust resistant ratchet wrench of claim 6, wherein a spring is installed in the insertion hole of the direction controller and stopped at the shaft of the pawl.

8. The water and dust resistant ratchet wrench of claim 6, wherein the insertion hole of the direction controller and the shaft of the pawl both have a triangular cross section.

9. The water and dust resistant ratchet wrench of claim 5, wherein the head of the handle comprises a receiving hole in communication with the pivot hole, and the connecting portion of the direction controller is provided with two positioning notches; a spring is installed in the receiving hole of the head of the handle and a steel ball is stopped at the spring and selectively engaged with one of the positioning notches.

10. A water and dust resistant ratchet wrench, comprising:

a handle having a head provided with a mounting hole and a pivot hole communicated with the mounting hole;

a ratchet wheel rotatably mounted in the mounting hole of the head of the handle;

a direction controller pivotally mounted in the pivot hole of the head of the handle;

a pawl connected with the direction controller and engaged with the ratchet wheel for being driven by the direction controller to change an engagement orientation between the pawl and the ratchet wheel so as to control a rotation direction of the ratchet wheel; and at least one O-ring sleeved onto the direction controller and abutted with a wall surface of the pivot hole of the handle;

wherein the direction controller comprises a pivot portion pivotally mounted in the pivot hole of the head of the handle, a connecting portion integrally formed with the pivot portion and connected with the pawl, and a tab integrally formed with the connecting portion and partially exposed outside the pivot hole of the head for being operated to drive the pivot portion of the direction controller to rotate in the pivot hole; wherein the tab is provided at an outer periphery thereof with an annular groove and the pivot portion is provided at an outer periphery thereof with an annular groove; wherein the water and dust resistant ratchet wrench comprises two said O-rings which are installed in the annular groove of the tab and the annular groove of the pivot portion respectively.

11. The water and dust resistant ratchet wrench of claim 10, wherein the connecting portion of the direction controller includes an insertion hole, and the pawl includes a tooth portion engaged with the ratchet wheel, and a shaft inserted into the insertion hole of the connecting portion of the direction controller.

12. The water and dust resistant ratchet wrench of claim 11, wherein a spring is installed in the insertion hole of the direction controller and stopped at the shaft of the pawl.

13. The water and dust resistant ratchet wrench of claim 11, wherein the insertion hole of the direction controller and the shaft of the pawl both have a triangular cross section.

14. The water and dust resistant ratchet wrench of claim 10, wherein the head of the handle comprises a receiving hole in communication with the pivot hole, and the connecting portion of the direction controller is provided with two positioning notches; a spring is installed in the receiving hole of the head of the handle and a steel ball is stopped at the spring and selectively engaged with one of the positioning notches.

* * * * *